United States Patent [19]

VerWeyst et al.

[11] Patent Number: 4,898,292

[45] Date of Patent: Feb. 6, 1990

[54] CONTAINER CLOSURE WITH HINGED FLAP

[75] Inventors: Gordon E. VerWeyst, Rockford, Ill.; Charles E. Burk, Beloit, Wis.; Douglas E. Pherigo, Loves Park, Ill.

[73] Assignee: J. L. Clark, Inc., Rockford, Ill.

[21] Appl. No.: 297,053

[22] Filed: Jan. 17, 1989

[51] Int. Cl.[4] ..... B65D 51/18

[52] U.S. Cl. ..... 215/237; 220/254; 220/339; 222/480

[58] Field of Search ..... 220/254, 307, 324, 337, 220/339; 215/235, 237, 238; 222/153, 480, 481, 482, 565

[56] References Cited

U.S. PATENT DOCUMENTS

| | | | |
|---|---|---|---|
| 3,322,308 | 5/1967 | Foster | 222/480 |
| 3,323,671 | 6/1967 | Minarik, Jr. et al. | 215/237 |
| 3,469,732 | 9/1969 | Foster | 220/324 |
| 3,675,812 | 7/1972 | Foster | 220/337 |
| 4,106,672 | 8/1978 | Tecco et al. | 220/339 X |
| 4,209,100 | 6/1980 | Uhlig | 215/237 X |
| 4,361,250 | 11/1982 | Foster | 220/339 X |
| 4,607,768 | 8/1986 | Taber et al. | 215/237 X |
| 4,621,744 | 11/1986 | Foster | 220/270 |
| 4,693,399 | 9/1987 | Hickman et al. | 222/480 |
| 4,807,768 | 2/1989 | Gach | 215/237 X |

*Primary Examiner*—Stephen Marcus
*Assistant Examiner*—Nova Stucker
*Attorney, Agent, or Firm*—Leydig, Voit & Mayer, Ltd.

[57] ABSTRACT

A flap is hinged on a container closure to swing between open and closed positions relative to a dispensing opening in the closure. When the flap is closed, upstanding ribs shield the free edge of the flap. A lift tab projects outwardly from the free edge of the flap and extends between the ribs to facilitate swinging of the flap to its open position. The flap is held releasably in its closed position by virtue of the ends of the ribs engaging the side edges of the tab with a snap fit and also by virtue of straight sections of the ribs engaging straight sections on the free edge of the flap with a snap fit at areas located adjacent the tab.

11 Claims, 2 Drawing Sheets

CONTAINER CLOSURE WITH HINGED FLAP

BACKGROUND OF THE INVENTION

This invention relates to a container closure and, more particularly, to a plastic closure having an opening enabling the contents of the container to be dispensed through the closure. The dispensing opening normally is closed by a hinged flap which is releasably held in a closed position and which may be swung upwardly to uncover the opening. A lift tab projects outwardly from the free edge of the flap and may be gripped and pulled to facilitate opening of the flap.

Even more specifically, the invention relates to a closure which is adapted to be screwed onto a container in the form of a bottle or jar. If the flap is located closely adjacent the lip of the container, difficulty is encountered in keeping the flap closed when the closure is threaded tightly onto the container and engages the lip. Forces applied to the closure as the latter is screwed down tend to cause the flap to pop open if the flap is held closed in a conventional manner.

SUMMARY OF THE INVENTION

The general aim of the present invention is to provide a new and improved closure having unique means for releasably holding the flap in its closed position and for resisting opening of the flap as the closure is screwed onto the container.

A more detailed object of the invention is to achieve the foregoing by providing a closure in which the lift tab is uniquely used to hold the flap closed by releasably locking the flap to the container in areas which are relatively free of deflecting forces.

The invention further resides in the provision of multiple hold-downs acting along mutually perpendicular zones to hold the flap securely closed during application of the closure to the container while permitting relatively easy opening of the closure when the lifting tab is gripped and pulled.

These and other objects and advantages of the invention will become more apparent from the following detailed description when taken in conjunction with the accompanying drawings.

DETAILED DESCRIPTION OF THE PREFERRED EMBODIMENT

Figure 1:
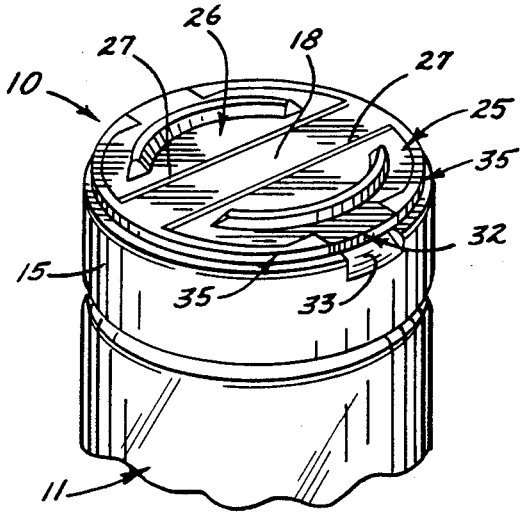
FIG. 1 is a fragmentary perspective view of a typical container equipped with a new and improved closure incorporating the unique features of the present invention, both flaps of the closure being shown in closed positions.

For purposes of illustration, the invention has been shown in the drawings as embodied in a one-piece closure 10 for sealing a container 11 which herein is a glass or plastic jar having a cylindrical neck 12 (FIG. 3) with an external thread 13 and an upper sealing lip 14. The closure is molded of resiliently yieldable plastic such as polypropylene and comprises a downwardly extending cylindrical skirt 15 formed with an internal thread 16 adapted to screw onto the neck of the jar.

Figure 2:
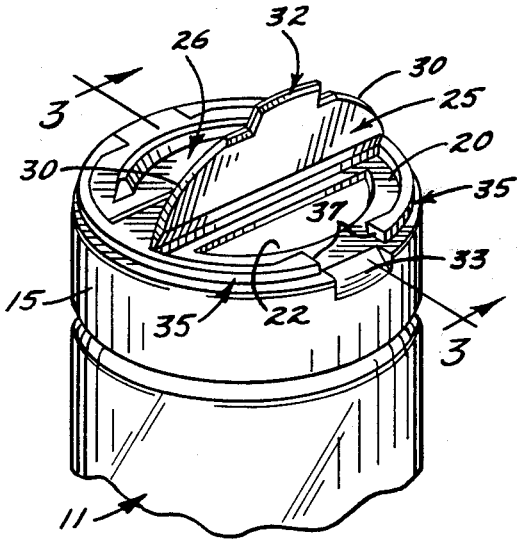
FIG. 2 is a view similar to FIG. 1 but shows one of the flaps of the closure in an open position.
Figure 3:
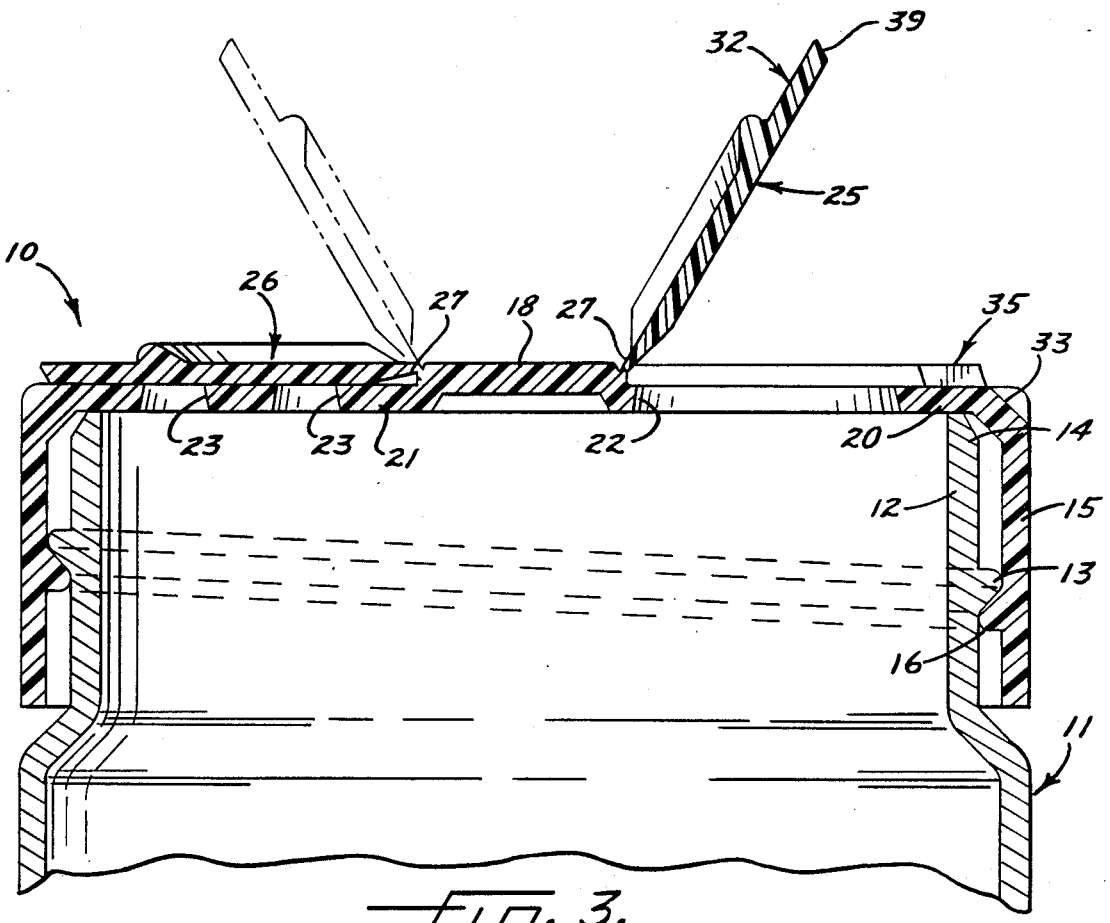
FIG. 3 is an enlarged fragmentary cross-section taken substantially along the line 3—3 of FIG. 2.

Extending diametrically across the upper margin of the skirt 15 is a comparatively wide horizontal web 18 having parallel sides. Recesses are located on opposite sides of the web with the bottoms of the recesses being defined by horizontal platforms 20 and 21 (FIG. 3). A large spoon and pour opening 22 (FIGS. 2 and 3) is formed vertically through the platform 20 while several sifter holes 23 are formed through the platform 21.

The spoon opening 20 and the sifter holes 21 are adapted to be closed by identical flaps 25 and 26, respectively, located on opposite sides of the web 18. Each flap is substantially semi-circular in shape and includes a straight margin which is joined to the adjacent side of the web 18 by a living hinge 27 (FIG. 3). By virtue of the hinge, each flap 20, 21 may be swung upwardly and downwardly between open and closed positions.

Since the flaps 20 and 21 are identical, a description of the flap 20 will also suffice for the flap 21. As shown most clearly in FIGS. 2 and 4, the flap 20 includes a free edge having two curved sections 30, each curved section extending from one end of the hinge 27 toward the midpoint of the flap. Midway along its length, the free edge of the flap is formed with an outwardly projecting lift tab 32 which may be gripped between a thumb and forefinger to facilitate upward swinging of the flap to its open position. The platform 20 and the upper margin of the skirt 15 are recessed immediately below the lift tab as indicated at 33 in order to enable a thumb nail to be placed beneath the tab.

Figure 5:
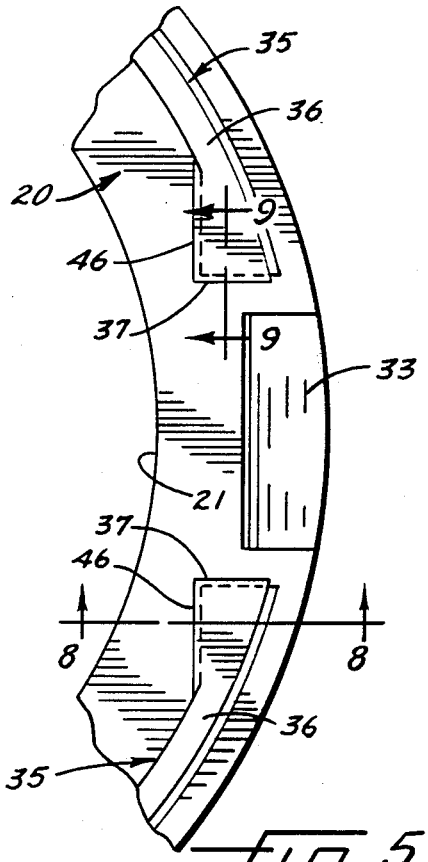
FIG. 5 is an enlarged fragmentary top plan view of the closure with the flap open.

The closure 10 is completed by two ribs 35 which extend upwardly from the platform 20. Each rib includes a curved section 36 (FIG. 5) which extends from one end of the hinge 27 and which, when the flap 25 is closed, lies alongside and shields the curved section 30 of the free edge of the flap. Adjacent ends 37 of the two ribs are spaced from one another and define a space for accommodating the lift tab 32 when the flap is in its closed position. The ribs also coact with the hinge 27 to define the sides of the recess whose bottom is formed by the platform 20. When the flap 25 is closed, it is located in the recess with its lower side disposed in face-to-face relation with the platform 20 and with its upper side disposed substantially flush with the upper side of the web 18 and the upper sides of the ribs 35.

Means are provided for releasably holding the flap 25 in its closed position. Attempts have been made to effect hold down of the flap by providing coacting detent means on the curved edges 30 of the flap and on the curved sections 36 of the ribs 35. It has been found, however, that the curved sections of the ribs deflect as the closure 10 is tightened and as the lower side of the platform 20 is pressed downwardly against the upper end of the lip 14 of the jar 11. As a result of such deflection, the curved sections of the ribs release the flap and allow the flap to pop open.

In accordance with the present invention, the flap 25 is releasably held in its closed position by unique means which are located adjacent the lift tab 32 and which are not subjected to any significant deflection during tightening of the closure 10. As a result, the flap remains closed when the closure is first applied at a processing plant to a newly filled jar.

Figure 7:
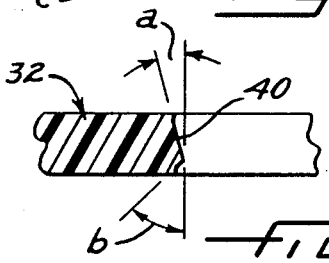

In the present instance, a first set of coacting hold-down means is provided on adjacent ends 37 of the two ribs 35 and on the adjacent side edges of the tab 32. As shown most clearly in FIG. 4, the tab is formed with a curved outer edge 39 and with two straight and parallel side edges 40. The side edges of the tab extend generally at right angles to the web 18. Each side edge is shaped as a protrusion which is generally V-shaped in cross-section as is shown in FIG. 7. Each protrusion includes an upper surface which is inclined relative to vertical at an angle a of about 15 degrees. In addition, each protrusion includes a lower surface which is inclined relative to vertical at an angle b of about 45 degrees.

Figure 9:
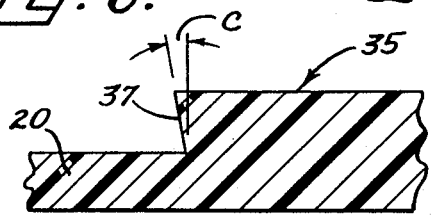
Figure 10:
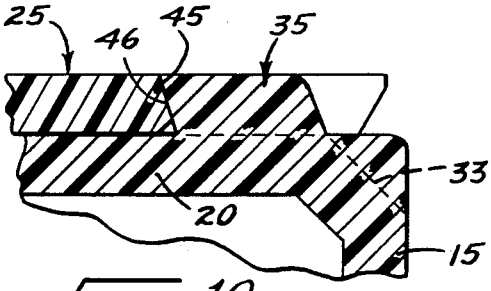
FIG. 10 is a fragmentary cross-section which is a composite of FIGS. 6 and 8 and which shows the flap closed.
Figure 11:
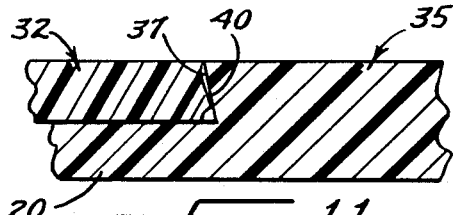
FIG. 11 is a fragmentary cross-section which is a composite of FIGS. 7 and 9 and which also shows the flap closed.

The ends 37 of the ribs 35 also extend at right angles to the web 18 and are shaped so as to coact with the V-shaped side edges 40 of the tab 32 and hold the flap 25 releasably in its closed position. For this purpose, the end 37 of each rib is undercut as shown in FIG. 9 and is inclined at an angle c of about 10 degrees and in such a direction that the surfaces defined at the two ends 37 converge toward one another upon progressing upwardly. As the flap is swung toward its closed position, the lower inclined surfaces of the V-shaped side edges 40 of the tab 32 cam against the upper sides of the ends 37 of the ribs 35 and deflect the same downwardly. As the flap reaches its fully closed position, the inclined upper surfaces of the side edges 40 move downwardly alongside the ends 37 of the ribs 35 and, as an incident thereto, the previously deflected upper sides of the ends 37 of the ribs snap back to their original positions and engage the side edges 40 with a snap fit as shown in FIG. 11 to releasably lock the flap in its closed position. Because the ends 37 of the ribs 35 and the side edges 40 of the tab 32 extend transversely of the closure 10 rather than circumferentially thereof, the coacting surfaces do not undergo any substantial deflection as the closure is screwed down circumferentially on the jar 11 and as the platform 20 is pressed downwardly against the upper lip 14 of the jar.

Figure 4:
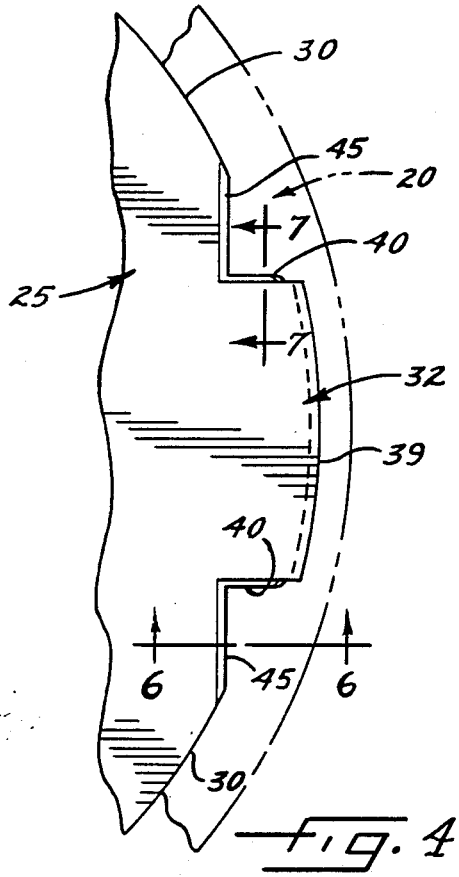
FIG. 4 is an enlarged fragmentary top plan view of one of the flaps.

Additional non-circumferentially extending means are provided to help hold the flap 35 closed. Specifically, these means comprise straight sections 45 (FIG. 4) formed on the free edge of the flap and coacting with straight sections 46 formed on the ribs 35 adjacent the ends 37 thereof. As shown in FIG. 4, each straight edge section 45 is perpendicular to the adjacent side edge 40 of the tab 32 and extends from such side edge to the curved section 30 of the edge of the flap 25. Each straight rib section 46 is coextensive with the adjacent straight edge section 45, is disposed perpendicular to the end 37 of the rib 35 and extends from such end to the curved section 36 of the rib.

Figure 6:
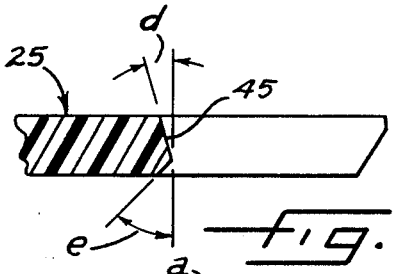
FIGS. 6 and 7 are enlarged fragmentary cross sections taken substantially along the lines 6—6 and 7—7, respectively, of FIG. 4.
Figure 8:
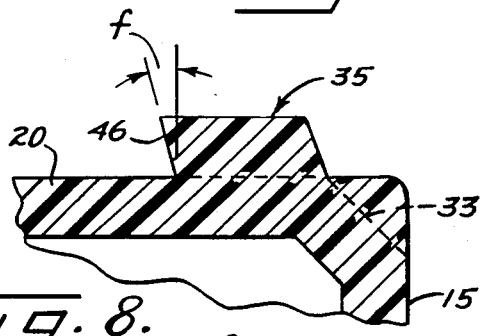
FIGS. 8 and 9 are enlarged fragmentary cross-sections taken substantially along the lines 8—8 and 9—9, respectively, of FIG. 5.

As shown in FIG. 6, each straight edge section 45 is shaped as a V-shaped protrusion having an upper surface inclined at an angle d of about 15 degrees and having a lower surface inclined at an angle e of about 45 degrees. Each straight rib section 46 is undercut along its inner side in substantially the same manner as the adjacent rib end 37 and is inclined at an angle f (FIG. 8) of about 15 degrees. As the flap is closed, the straight edge sections 45 first deflect the straight rib sections 46 and then snap beneath the straight rib sections to hold the flap down. Because the sections 45 and 46 extend chordwise of the closure 10 rather than circumferentially thereof, such sections are not deflected to any significant degree when the closure is tightened onto the jar 11.

From the foregoing, it will be apparent that the present invention brings to the art a new and improved closure 10 in which the flap 25 is held down by virtue of the coaction of multiple sets of straight edges 37, 40 and 45, 46, located adjacent the lift tab 32. As a result, the flap is not likely to pop open when the closure is initially applied to a newly filled container. Although the flap is held securely, it may be swung open quite easily when a lifting force is applied to the tab.

We claim:

1. A one-piece container closure molded of resiliently yieldable plastic, said closure comprising a generally horizontal platform formed with a vertically extending dispensing opening, a closure flap, a hinge extending across said platform and supporting said flap to swing upwardly and downwardly between open and closed positions relative to said dispensing opening, said flap lying in face-to-face relation with said platform when in said closed position, said flap having a free edge extending around said flap from one end of said hinge to the other end thereof, a lift tab projecting outwardly from said free edge approximately midway along the length of said free edge to facilitate swinging of said flap to said open position, ribs upstanding from said platform and shielding the free edge of said flap when said flap is in said closed position, said ribs having adjacent ends which are spaced from one another to define a space between said ribs for said lift tab, said lift tab having side edges located adjacent the ends of said ribs, and means on the ends of said ribs and coacting with the side edges of said lift tab to hold said flap releasably in said closed position.

2. A closure as defined in claim 1 in which said means comprise an undercut surface on the end of each rib, the surfaces on adjacent ends of said ribs being inclined so as to converge toward one another upon progressing upwardly.

3. A closure as defined in claim 2 in which each side edge of said tab is defined by a protrusion which is generally V-shaped in cross-section, the lower side of each protrusion engaging the end of the adjacent rib and camming such end downwardly as said flap is swung toward said closed position, and the upper side of each protrusion moving alongside the undercut surface on the end of each rib as said flap reaches said closed position.

4. A closure as defined in claim 1 in which the free edge of said flap includes straight sections extending from the side edges of said tab and further includes curved sections extending from said straight sections toward the ends of said hinge, said ribs having straight and curved sections located adjacent the straight and curved sections, respectively, of said free edge when said flap is in said closed position, and means on the straight sections of said ribs and coacting with the straight sections of said free edge to releasably hold said flap in said closed position.

5. A one-piece container closure molded of resiliently yieldable plastic, said closure comprising a generally horizontal platform formed with a vertically extending dispensing opening, a closure flap, a hinge extending across said platform and supporting said flap to swing upwardly and downwardly between open and closed positions relative to said dispensing opening, said flap lying in face-to-face relation with said platform when said flap is in said closed position, said flap having a free edge extending around said flap from one end of said hinge to the other end thereof, a lift tab projecting outwardly from said free edge approximately midway along the length of the free edge to facilitate swinging of said flap to said open position, ribs upstanding from said platform and shielding the free edge of said flap when said flap is in said closed position, said ribs having adjacent ends which are spaced from one another to define a space between said ribs for said lift tab, said ribs having straight sections extending from said ends and having curved sections extending from said straight sections toward the ends of said hinge, the free edge of said flap having straight and curved sections which lie adjacent the straight and curved sections, respectively, of said ribs when said flap is in said closed position, and means on the straight sections of said ribs and coacting with the straight sections of said free edge to hold said flap releasably in said closed position.

6. A closure as defined in claim 5 in which said means comprise an undercut surface on the inner side of each rib.

7. A closure as defined in claim 6 in which each straight section of said free edge is defined by a protrusion which is generally V-shaped in cross-section, the lower side of each protrusion engaging the upper side of the straight section of the adjacent rib and camming such straight section downwardly as said flap is swung toward said closed position, and the upper side of each protrusion moving alongside the undercut surface on the straight section of the adjacent rib as said flap reaches said closed position.

8. A closure as defined in claim 5 in which said tab includes side edges which are located adjacent the ends of said ribs when said flap is in said closed position, and means on the ends of said ribs and coacting with the side edges said tab to hold said flap releasably in said closed position.

9. A one-piece container closure molded of resiliently yieldable plastic, said closure comprising a generally horizontal platform formed with a vertically extending dispensing opening, a closure flap, a hinge extending across the top of said platform and supporting said flap on said platform to swing upwardly and downwardly between open and closed positions relative to said dispensing opening, said flap lying in face-to-face relation with said platform when said flap is in said closed position, said flap having a free edge extending around said flap from one end of said hinge to the other end thereof, a lift tab projecting outwardly from said free edge approximately midway along the length of the free edge to facilitate swinging of said flap to said open position, ribs upstanding from said platform and shielding the free edge of said flap when said flap is in said closed position, said ribs having adjacent straight and parallel ends which are spaced from one another to define a space between said ribs for said lift tab, said tab having parallel side edges located adjacent the ends of said ribs, means on the ends of said ribs and coacting with the side edges of said tab to hold said flap releasably in said closed position, said ribs having straight sections extending from said ends and having curved sections extending from said straight sections toward the ends of said hinge, the free edge of said flap having straight and curved sections which lie adjacent the straight and curved sections, respectively, of said ribs when said flap is in said closed position, and means on the straight sections of said ribs and coacting with the straight sections of said free edge to hold said flap releasably in said closed position.

10. A closure as defined in claim 9 in which the straight sections of said ribs extend perpendicular to the ends of said ribs, the straight sections of said free edge extending perpendicular to the side edges of said tab.

11. A closure as defined in claim 9 in which the ends of said ribs and the side edges of said tab extend at right angles to said hinge.

* * * * *